US007563326B2

(12) United States Patent
Tietz et al.

(10) Patent No.: US 7,563,326 B2
(45) Date of Patent: Jul. 21, 2009

(54) DEVICE FOR COATING AND DRYING BOTH SIDES OF A MATERIAL WEB OF PAPER OR BOARD

(75) Inventors: Martin Tietz, Heidenheim (DE); Richard Aust, Mönchengladbach (DE); Stefan Reich, Heidenheim (DE); Christoph Henninger, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 650 days.

(21) Appl. No.: 11/023,940

(22) Filed: Dec. 22, 2004

(65) Prior Publication Data

US 2005/0115494 A1 Jun. 2, 2005

Related U.S. Application Data

(63) Continuation of application No. PCT/EP03/06479, filed on Jun. 18, 2003.

(30) Foreign Application Priority Data

Jun. 24, 2002 (DE) ..... 102 28 114

(51) Int. Cl.
*B05B 7/06* (2006.01)
*B05B 13/02* (2006.01)
*B05C 3/12* (2006.01)

(52) U.S. Cl. ..... 118/316; 118/325; 118/420; 118/67

(58) Field of Classification Search ..... 118/300, 118/302, 325, 410–413, 419, 420, 62–69, 118/DIG. 4; 427/420
See application file for complete search history.

(56) References Cited

U.S. PATENT DOCUMENTS

| | | | | |
|---|---|---|---|---|
| 2,299,026 | A | 10/1942 | Merrill | 91/45 |
| 3,782,995 | A * | 1/1974 | Hisashi et al. | 427/209 |
| 5,639,303 | A | 6/1997 | Plomer | 118/218 |
| 5,976,630 | A * | 11/1999 | Korokeyi et al. | 427/420 |
| 5,992,040 | A | 11/1999 | Nordang | 34/114 |
| 6,051,068 | A | 4/2000 | Kohl et al. | 118/641 |
| 6,309,463 | B1 | 10/2001 | Hess et al. | 118/302 |
| 6,309,704 | B1 | 10/2001 | Hess et al. | 427/315 |
| 2002/0066404 | A1 | 6/2002 | Ueberschar | 118/261 |

FOREIGN PATENT DOCUMENTS

| | | |
|---|---|---|
| CA | 2295146 | 9/2000 |
| DE | 19743246 | 4/1999 |
| DE | 10012345 | 9/2001 |
| EP | 1375746 | 6/2003 |
| WO | WO 03/031080 | 4/2003 |

* cited by examiner

*Primary Examiner*—Yewebdar T Tadesse
(74) *Attorney, Agent, or Firm*—Taylor & Aust, P.C.

(57) ABSTRACT

A coating/drying device including a first application device, a second application device and a drying device. The first application device for applying application medium to a first side of a fiber material web, moving in a running direction. The second application device for applying application medium to a second side of the fiber material web, the second side being opposite the first side. The second application device being an application device operating without contacting the fiber material web. The drying device is arranged downstream of the first application device and the second application device in the running direction of the fiber material web.

29 Claims, 6 Drawing Sheets

DEVICE FOR COATING AND DRYING BOTH SIDES OF A MATERIAL WEB OF PAPER OR BOARD

CROSS REFERENCE TO RELATED APPLICATIONS

This is a continuation of PCT application No. PCT/EP2003/006479, entitled "DEVICE FOR COATING AND DRYING THE FRONT AND BACK OF A WEB, PARTICULARLY ONE CONSISTING OF PAPER OR CARDBOARD", filed Jun. 18, 2003.

BACKGROUND OF THE INVENTION

1. Field of the Invention

The invention relates to a coating/drying device having a first application device for applying liquid or pasty application medium to a first side of a material web, in particular of paper or board, moving in the running direction, and having a second application device for applying liquid or pasty application medium to a second side of the material web, opposite the first side.

2. Description of the Related Art

Coating/drying devices are generally known in the prior art. In these devices, it is usual for a layer of application medium to be applied to one side of the material web and for this then to be dried in a drying device. Only then is an application medium layer applied to the other side of the material web and likewise dried. The disadvantage with these coating/drying devices is, firstly, that two drying devices have to be provided, which is not only expensive in terms of procurement and maintenance of these drying devices but, moreover, significantly more overall space is required. Secondly, the energy efficiency of single-sided drying, that is to say the drying effect per unit of energy applied, leaves much to be desired.

What is needed in the art is a coating/drying device, which permits both sides of the material web to be coated and dried in a space-saving and energy-saving manner.

SUMMARY OF THE INVENTION

According to the present invention, a coating/drying device of the generic type is utilized in which the second application device is an application device acting without contact and in which the drying device is arranged downstream of the two application devices in the running direction of the material web. According to the present invention, therefore, no intermediate drying is carried out, that is to say no drying device is provided between the position of the first application device and the position of the second application device. This saves overall space otherwise required for the second drying device and the cost required for the procurement and the maintenance of the second drying device. Furthermore, the heat provided by the drying device can be absorbed not just by one moist application medium layer but by two moist application medium layers. The heat absorption, which is higher as a result, improves the energy efficiency of the coating/drying device according to the present invention as compared with coating/drying devices from the prior art.

According to another aspect of the present invention, the two application devices are arranged substantially at the same position in the running direction of the material web, and the drying device is arranged downstream of the two application devices in the running direction of the material web. At least one, preferably both, of the application devices can advantageously be designed as an application device acting without contact. However, it is not ruled out that at least one of the application devices is an application device transferring the application medium indirectly by way of a transfer surface of a transfer element, preferably a transfer roll, carrying the application medium in the form of an application medium layer.

By way of a configuration according to another embodiment of the present invention of the coating/drying device, it is possible to dispense with the intermediate drying if both sides of the material web are coated. This dispensing with intermediate drying, in the case of the arrangement of the two application devices substantially at the same position in the running direction of the material web, is also entirely compatible with an application acting with contact. If appropriate the medium is applied in excess to the material web.

The application device, acting without contact, applies the application medium to the material web substantially without any excess, known as a "1:1 application". It therefore needs no excess application medium to be doctored off and no physical contact with the material web is required. As a result of this, the application device, acting without contact, stresses the material web to only a low extent, specifically only by way of the softening of the material web from the liquid contained in the application medium. The application device, acting without contact, can be a spray application device or a curtain application device.

In principle, the first application device can also be an application device coating the material web with contact. For example, a blade application device may be used, that is to say an application device having a doctor blade for evening out and/or metering the applied layer of application medium. Alternatively, the application device may be a film application device, that is to say an application device in which the material web runs through a nip formed between two rolls and, in this nip, the web is brought into contact with a film of application medium applied to the surface of one of the rolls. According to the invention, it is preferred if the first application device is also an application device acting without contact, for example, a curtain application device. The low stressing of the material web is important in connection with the present invention, in particular since, the material web does not experience any intermediate consolidation by way of the withdrawal of moisture in an intermediate drying device between the two application devices.

Depending on the overall space available, and the other boundary conditions for the arrangement of the coating/drying device, at least one of the curtain application devices can apply the application medium to the material web from above under the force of gravity. Additionally or alternatively, at least one of the curtain application devices can be assigned a deflection device, which deflects the application medium curtain from the curtain application device out of its course under the force of gravity. The deflection of the application medium curtain can be based, for example, on an electrostatic and/or electromagnetic interaction between the application medium in the application medium curtain and the deflection device. Electrostatically and/or electromagnetically operating deflection devices of this type are known in the prior art and will therefore not be explained in more detail here.

The application medium curtain from both curtain application devices may be deflected out of its respective course under the force of gravity by way of a deflection device. According to an exemplary web course, the material web can run substantially vertically from bottom to top, the two curtain application devices being arranged on either side of the material web. The two application medium curtains are deflected from their course under the force of gravity, which does not lead to any wetting of the material web, into an operating course wetting the material web, by utilizing the deflection device. In the case of the deflection of both application medium curtains, it is advantageous if the two application devices are arranged substantially at the same position in the running direction of the material web.

Furthermore, the two application devices may be arranged on a section of the material web running substantially in the vertical direction, preferably moving from bottom to top. If mention is made here of "running substantially in the vertical direction", this is intended to include entirely more severe angular deviations from an exactly vertical course, if appropriate up to ±45°. However, a lower angular deviation from the exactly vertical course, for example ±20°, is more expedient.

The second application device can be arranged downstream of the first application device by a predetermined distance in the running direction of the material web. For example, the two application devices can be arranged in the sections of the run of the material web that run substantially horizontally, in order to permit application of the application medium from above. This is advantageous in particular when curtain application devices are used. Since this application "from above" is still readily possible even given deviations of up to 45° from an exactly horizontal course of the material web, the formulation "running substantially horizontally" is to be interpreted in a correspondingly manner.

An arrangement of the application devices, one above another, which utilizes the overall height available and thus saves overall length, results, for example, if the material web between the sections that run substantially horizontally is deflected through substantially 180° by way of at least one web deflection unit. It goes without saying that the formulation "deflected through substantially 180°" is also to be interpreted widely in accordance with the above and can cover deflections from about 140° to about 210°.

In order to be able to prevent any influence on the surface properties of the application medium layer just applied, and thus still moist, by the web deflection units, responsible for the curved web courses, provision is made for the web deflection units between the first application device and the second application device to be arranged on the uncoated, second side of the material web. However, if use is made of what are known as "air turns", that is to say deflection units in which the material web is guided without contact on a compressed air cushion expelled from these "air turns", the web deflection units between the first application device and the second application device can also be arranged on the coated, first side of the material web.

Finally, it is also possible for a web turning device to be arranged between the first application device and the second application device. The axles or shafts of the deflection units of this web turning device run parallel to a section of the material web running into the respective deflection unit and at a predetermined angle with respect to the transverse direction of this web section. In this connection, "air turns" can also be used as web deflection units. These can be constructed, for example, as perforated pipes, the perforations being used to expel compressed gas for forming a compressed gas cushion.

Irrespective of the arrangement of the two application devices, it is advantageous if the two application devices are accommodated in a common housing, in order to prevent contamination of the entire coating installation by application medium droplets or the like.

In a development of the present invention, the curved sections of the web run between the first application device and the drying device have a radius of curvature of at least 300 mm. Only if this minimum radius of curvature is observed is it ensured that, in the region of the curved sections of the web run, the centrifugal forces acting on the still moist application layers are so low that application medium droplets are prevented from being thrown off under centrifugal force. This applies in particular at web speeds of more than 1000 m/min.

The coating/drying device, according to the present invention, can advantageously have at least one non-contacting device for stabilizing the moving material web and/or for avoiding or reducing corrugations, in particular transverse corrugations, of the moving material web. For example, at least one coanda effect nozzle arrangement can advantageously be provided. The present invention includes the use of at least one nozzle arrangement for producing an opposing corrugation, in particular a longitudinal corrugation, thereby counteracting a corrugation in particular a transverse corrugation.

Furthermore, the coating/drying device according to one embodiment of the presnent invention can advantageously have at least one device for disrupting and preferably for eliminating or reducing an air boundary layer dragged along by the moving material web. The device should ideally be arranged shortly or immediately upstream of a respective application device, in order that the application of the application medium is not disrupted by the air boundary layer, so that a coating meeting high quality requirements is achieved.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
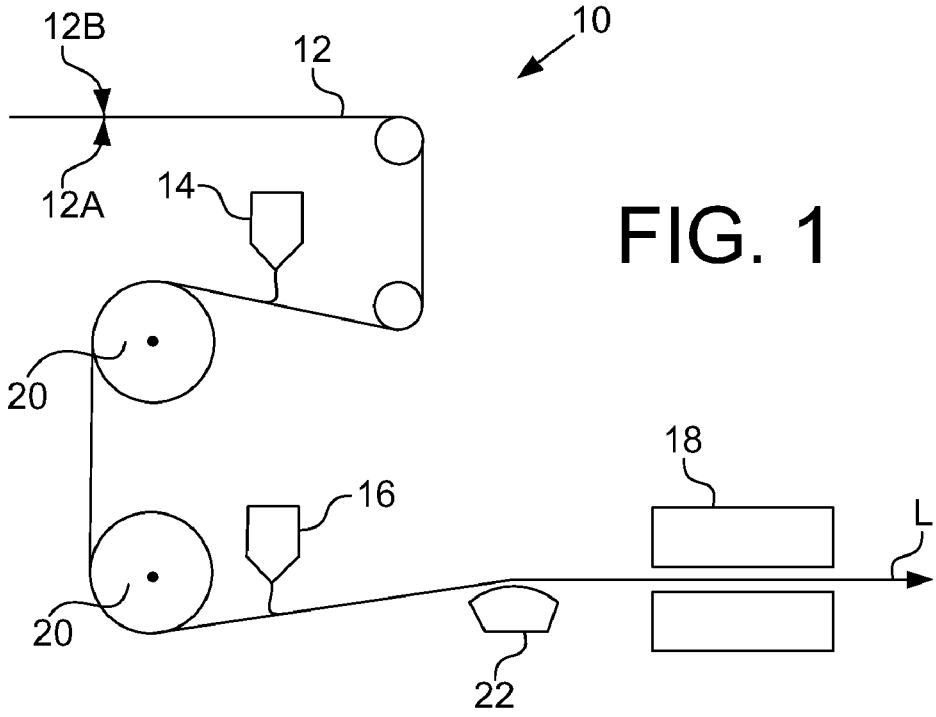
FIGS. 1 to 4 show schematic illustrations of arrangements and web runs in embodiments of coating/drying devices according to the present invention.

Referring now to the drawings, and more particularly to FIG. 1, a coating/drying device according to the present invention is designated generally by 10. It includes a first application device 14 for applying a first layer of application medium to a first side 12*a* of a material web 12 moving in a running direction. There is additionally a second application device 16, for applying a second layer of application medium to side 12*b* of material web 12 opposite side 12*a*,and a drying device 18, which is arranged downstream of application devices 14 and 16 in running direction L of material web 12. According to the present invention, the web run between application devices 14 and 16 is free of further drying devices. This means that material web 12 does not experience any intermediate drying between applicator 14 and applicator 16.

As indicated in FIG. 1, application devices 14 and 16 in one embodiment are constructed as curtain application devices. That is to say they are application devices in which the application medium leaves a nozzle of the application device as a self-contained application medium curtain and moves through the free space toward material web 12 under the influence of external forces, in particular the force of gravity. This non-contact type of application of application medium to material web 12 ensures that material web 12 is stressed only to a low extent. In particular, there is no risk of damage resulting from physical interaction between material web 12 and elements of the application devices, such as doctor blades, metering rolls or the like. In principle, however, application devices 14 and 16 could also be constructed as spray application devices.

Furthermore, application devices 14 and 16 are arranged in sections 12' and 12" of the course of material web 12, which run substantially horizontally and they apply application medium to material web 12 substantially from above. In order to permit this arrangement, according to FIG. 1, deflection rolls 20 are provided, which deflect material web 12 between application devices 14 and 16. Deflection rolls 20 are both arranged on the still uncoated side 12*b* of material web 12, so that they cannot impair the layer applied to side 12*a* of material web 12 by application device 14. In addition, deflection rolls 20 have a relatively large diameter, so that, during the deflection of material web 12, only low centrifugal forces act on the layer applied to material web 12 by application device 14.

Finally, a deflection device 22, operating without contact, is also arranged between application device 16 and drying device 10. Deflection device 22 can be formed, for example, by what is known as an "air turn", which guides material web 12 without contact on a compressed air cushion.

Figure 2:
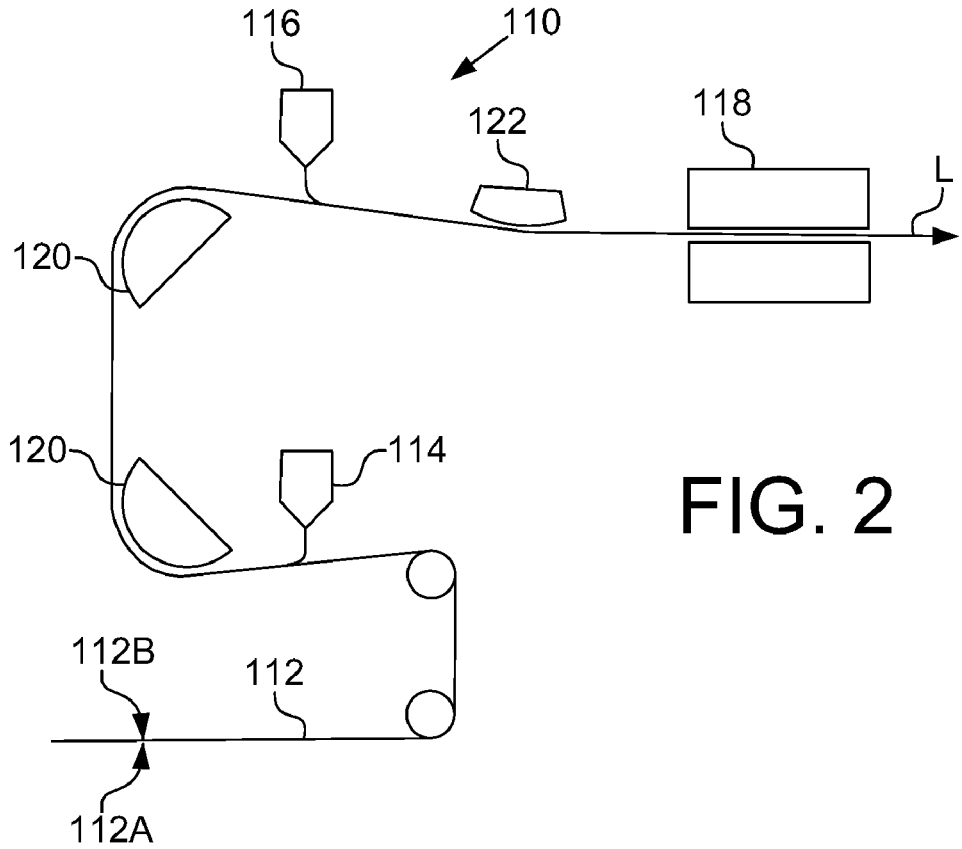

A further embodiment of a coating/drying device according to the present invention, which corresponds substantially to the embodiment according to FIG. 1, is illustrated in FIG. 2. Therefore, in FIG. 2 analogous parts are provided with the same designations as in FIG. 1 but increased by the number 100. Furthermore, the embodiment according to FIG. 2 will be described in the following text only to the extent to which it differs from the embodiment according to FIG. 1, to whose description reference is hereby otherwise expressly made.

Coating/drying device 110 according to FIG. 2 differs from coating/drying device 10 only with regard to the construction of deflection units 120, which deflect material web 112 between first curtain application device 114 and second curtain application device 116. Specifically, deflection units 120 according to FIG. 2 are arranged on side 112*a* of material web 112, which is coated first. They are therefore constructed as deflection devices operating without contact, for example what are known as "air turns", as explained with reference to the embodiment according to FIG. 1, using the example of deflection device 22. In the embodiment according to FIG. 2, deflection device 122 operates-without contact and is provided between application device 116 for coating second side 112*b* of material web 112 and drying device 118.

Figure 3:
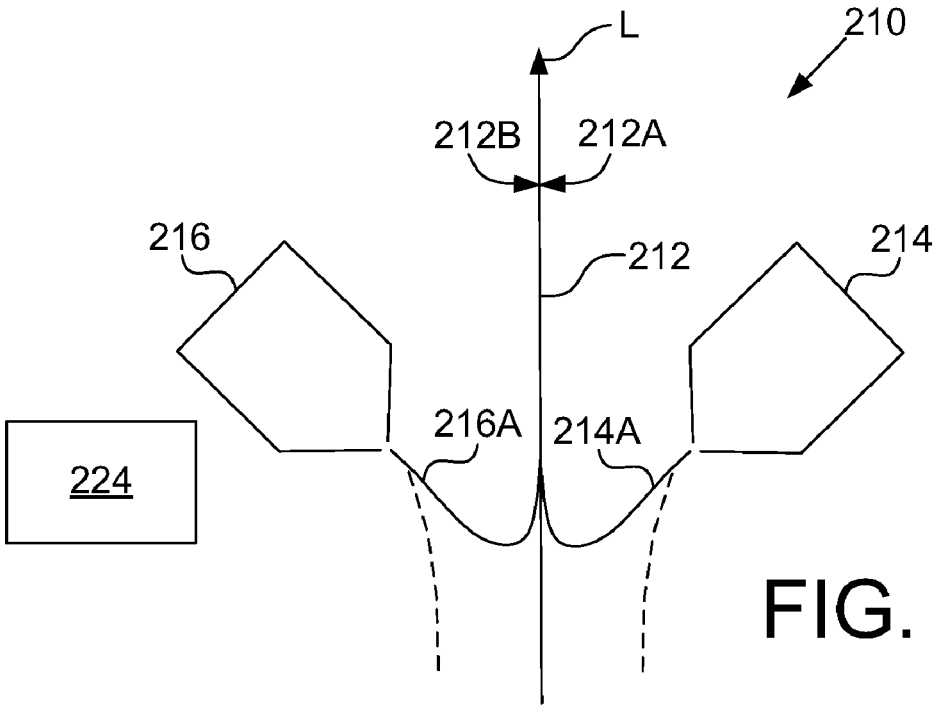

A further embodiment of a coating/drying device according to the present invention, which corresponds substantially to the embodiment according to FIG. 1, is illustrated in FIG. 3. Therefore, in FIG. 3 analogous parts are provided with the same designations as in FIG. 1 but increased by the number 200. Furthermore, the embodiment according to FIG. 3 will be described in the following text only to the extent to which it differs from the embodiment according to FIG. 1, to whose description reference is hereby otherwise expressly made.

In coating/drying device 210 according to FIG. 3, curtain applicators 214 and 216 are arranged on either side of a material web 212 moving substantially from bottom to top. By way of deflection device 224, merely indicated schematically, application medium curtains 214*a* and 216*a* from application devices 214 and 216 are deflected from their course purely under the force of gravity, indicated by dashed lines in FIG. 3, into a course wetting surfaces 212*a* and 212*b* of material web 212. Deflection device 224 can, for example, operate on the basis of an electrostatic interaction with the application medium.

Figure 4:
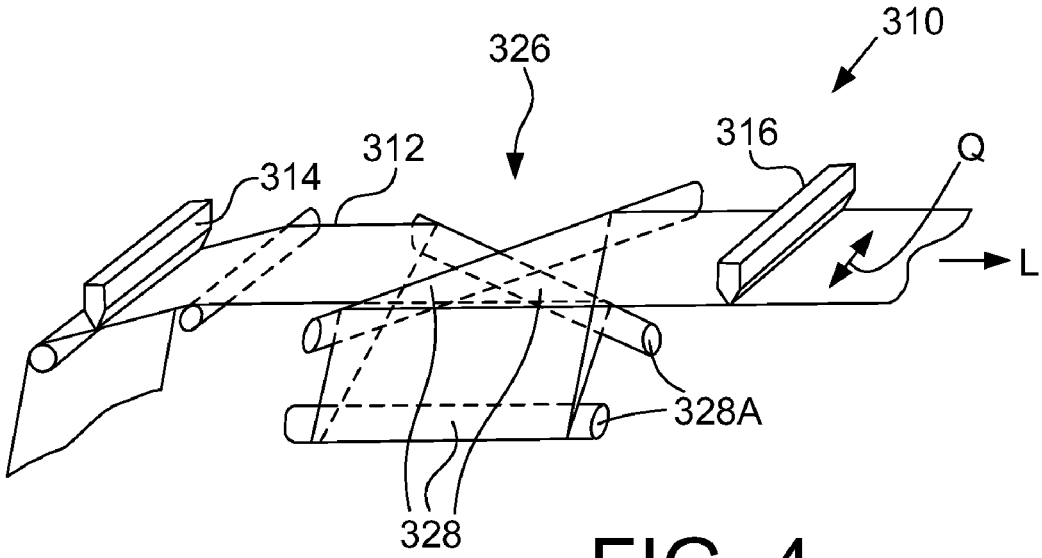

A further embodiment of a coating/drying device according to the present invention, which corresponds substantially to the embodiment according to FIG. 1, is illustrated in FIG. 4. Therefore, in FIG. 4 analogous parts are provided with the same designations as in FIG. 1 but increased by the number 300. Furthermore, the embodiment according to FIG. 4 will be described in the following text only to the extent to which it differs from the embodiment according to FIG. 1, to whose description reference is hereby otherwise expressly made.

Coating/drying device 310 according to FIG. 4 differs from the embodiment according to FIGS. 1 and 2 only in the manner in which material web 312 is deflected between first curtain application device 314 and second curtain application device 316. To be specific, according to FIG. 4 a web turning device 326 is used for this purpose. Axles or shafts 328*a* of deflection units 328 of web turning device 326 run parallel to a web section of material web 312 running into the respective deflection unit 328 and at a predetermined angle with respect to the transverse direction Q of this web section. Axles and shafts 328*a* are constructed as a pipe and have a large number of openings which, in conjunction with a compressed air source, lead to the formation of an air cushion carrying web 312.

Figure 5:
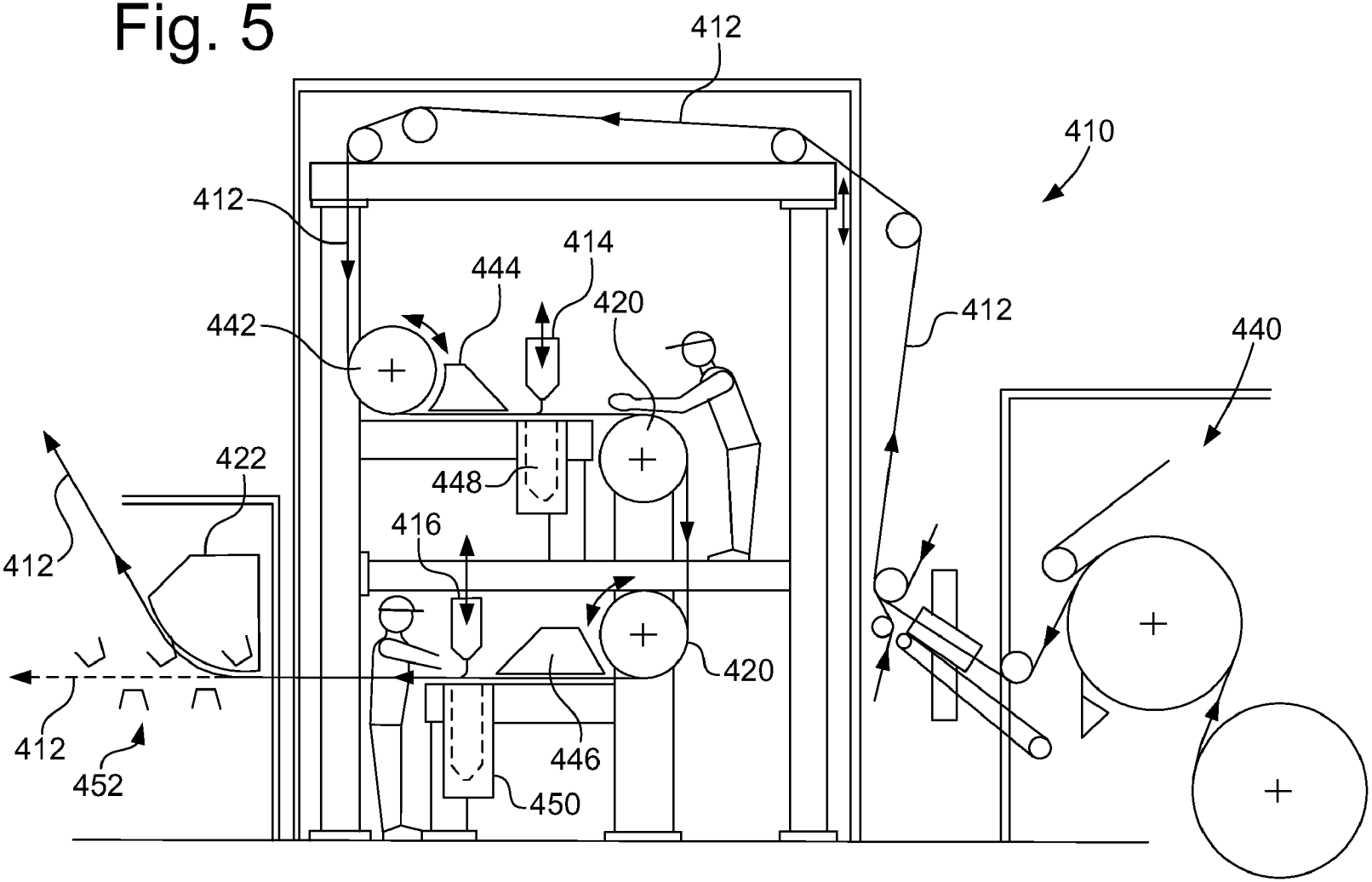
FIG. 5 shows another embodiment of a coating device according to the present invention, which is connected downstream of a drying section in a papermaking machine.

FIG. 5 shows a coating device 410 according to the present invention connected downstream of a drying section 440 in a papermaking machine. Moving material web 412 is led from above and into the coating device, also known as the coater. Deflection of web 412 is carried out by way of a guide roll 442. The guidance of web 412 is carried out by a first curtain application device 414 and a second curtain application device 416, which corresponds substantially to the exemplary embodiment of FIG. 1. Use is also made of two deflection rolls 420. However, upstream of the respective application device, an element is provided for eliminating, or at least reducing, an air boundary layer dragged along by moving material web 412, for example a suction box 444 or 446.

As indicated by double arrows, application devices 414 and 416 can be adjusted vertically. Material web 412 runs between application device 414 or 416 and a respective trough 448 or 450, which collects excess application medium.

After passing under second application device 416, material web 412 is led over an air turn 422 to a drying device operating without contact (not illustrated). For instance, a hot air dryer can be provided. As an alternative or addition to air turn 422, guidance can also be provided by air nozzles 452. An exemplary course of material web 412 through air nozzles 452 is illustrated by dashed line 412'. Air nozzles 452 can be arranged in such a way that a slight corrugation in the moving material web 412 with wave troughs and wave peaks following one another in the running direction or longitudinal direction of the material web is produced. Such corrugation counteracts undesired transverse corrugation of material web 412 with wave peaks and wave troughs following one another in the transverse direction.

With regard to deflection rolls 420, consideration is primarily given to these having a comparatively large diameter, for example larger than 600 mm, in order to avoid throwing off the application medium, also known as the coating color.

As can clearly be seen from FIG. 5 no intermediate drying of material web 412 is provided between the application by first application device 414 and by second application device 416. An important point of view of the web guidance implemented in accordance with FIG. 5 is that the respectively coated web side does not touch any web guide roll or the like until adequate drying has been completed.

Figure 6:
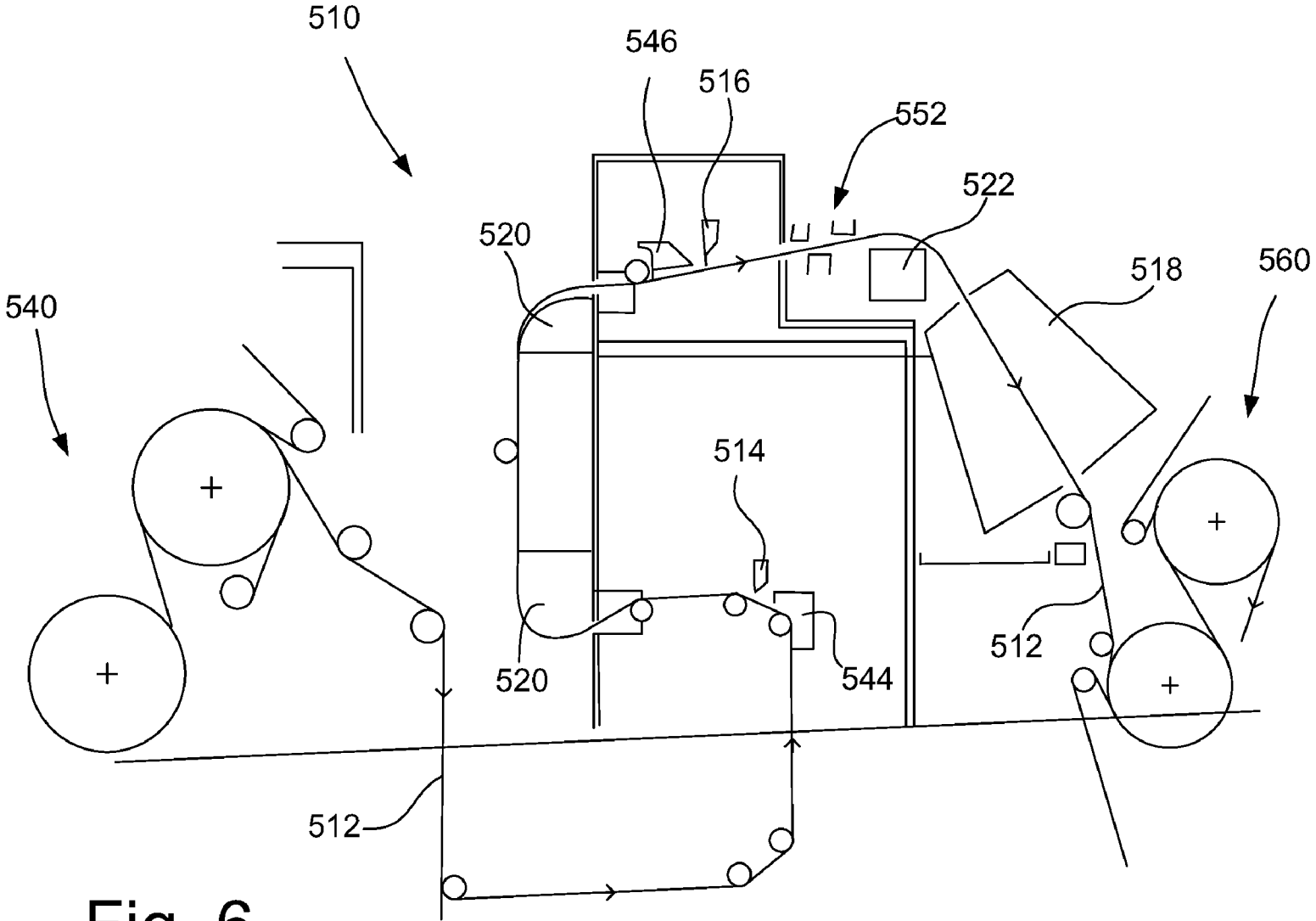
FIG. 6 likewise shows an example of a coating/drying device in a papermaking machine.

In the arrangement according to FIG. 6, the coating/drying device is likewise connected downstream of a drying section 540 within a papermaking machine. Material web 512 is led into the coating device from below and this is followed by deflection of the web counter to the machine running direction by way of a plurality of guide rolls. First application device 514 has an element for leading away/avoiding an air boundary layer connected upstream, for example a suction box 544. In a manner similar to that in the arrangement according to FIG. 2, material web 512 is deflected by way of two air turns 520, so that material web 512 is deflected into the machine running direction again. Second application device 516 applies coating material to the material web section moving in the machine running direction. An element 546, for leading away/avoiding the air boundary layer, is connected upstream of second application device 516.

Two air turns 520 act with their guide air on the side of the material web coated by first application device 514. It is possible for the other, not yet coated, side of the material web to be assigned one or more supporting rolls, in order to ensure defined and stable material web guidance. After material web 512 has passed under second application device 516, which is preferably designed as a curtain application device, just like first application device 514, material web 512 runs through air nozzles 552 used for stabilization. Web 512 is then deflected by way of a further air turn 522 into a contactless dryer 518, downstream of which, a further drying device 560 operating with contact in the manner of a normal drying section can be connected.

Of material web 512 fed to the respective coating/drying device, according to FIG. 5 and FIG. 6 first the underside and then the top side of web 512 is coated. The converse can certainly also be provided, namely that the top side is coated first and then the underside. Both solutions according to FIGS. 5 and 6, just like the solutions of the preceding exemplary embodiments, are very compact and are therefore also suitable as a rebuilding measure in existing installations. As compared with conventional solutions, for example blade and film coating instead of the curtain coating, it is possible to assume considerably lower investment costs, which is achieved in particular by dispensing with the intermediate drying and by the compactness associated therewith.

Figure 7:
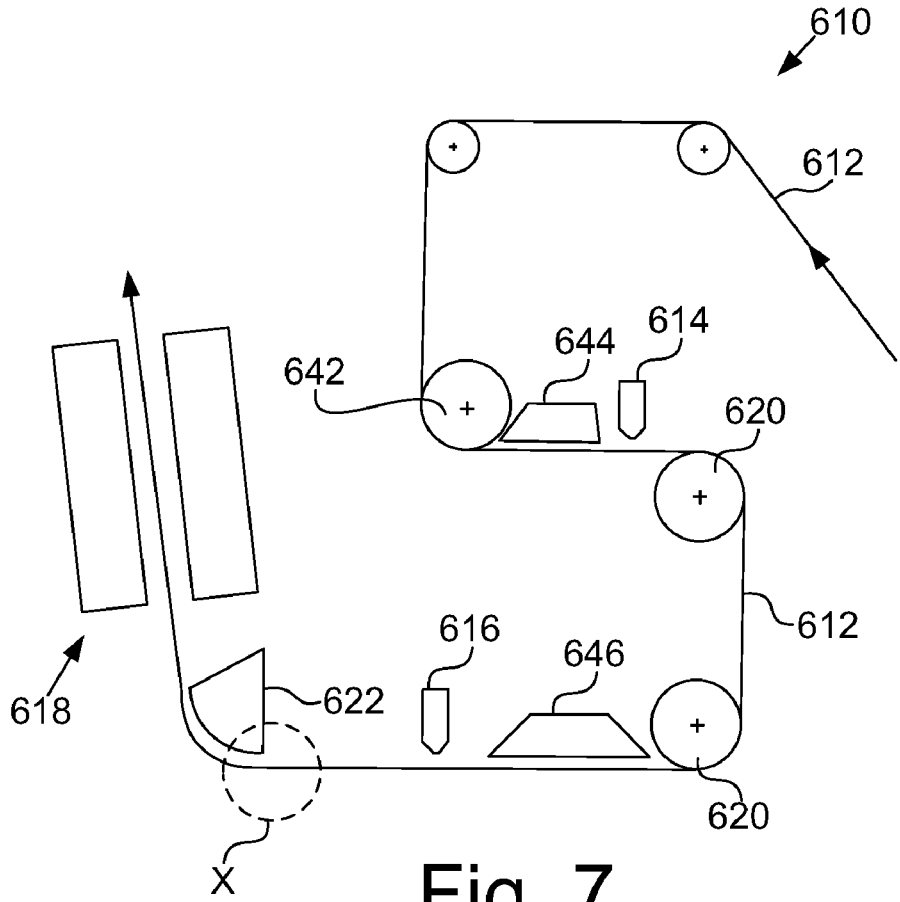
FIGS. 7 to 9 illustrate further schematic illustrations of arrangements and web runs in embodiments of coating/drying devices according to the present invention.

Coating/drying device 610 according to FIG. 7 largely corresponds to the arrangement according to FIG. 5. As already stated in the preceding exemplary embodiments, the same designations are used for analogous or corresponding components, in each case increased by 100. It is possible to see the deflection rolls bringing about the deflection, counter to the machine running direction. First curtain applicator 614 interacts with the underside of material web 612. Elements 644 are connected upstream for air boundary layer elimination, although a suction box may be used a type of doctor blade is also suitable. Deflection rolls 620 bring about the deflection of web 612 into the machine running direction again. Second curtain application device 616 is positioned with an element 646 connected upstream for air boundary layer elimination. Further guidance of material web 612 is completed over an air turn 622 into contactless dryer 618. In region X, identified by a dashed circle, a coanda effect arrangement or stabilizing nozzle arrangement, corresponding to arrangement 452 or 552, can be provided.

Figure 8:
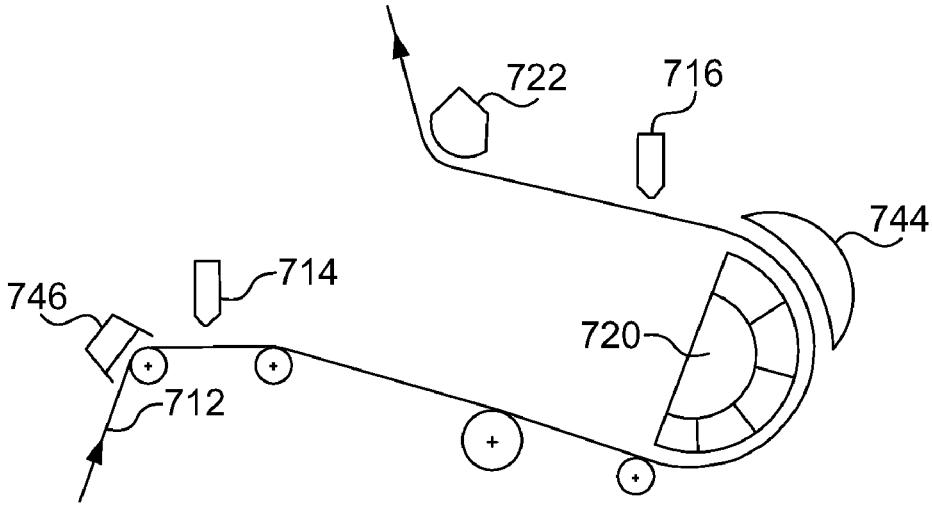

A further expedient arrangement is shown in FIG. 8. In each case a suction box 744 and 746, or another element for air boundary layer elimination or reduction, is connected upstream of curtain applicators 714 and 716. An air turn arrangement 720, designed with segments and an air turn 722, brings about the non-contact web deflection toward second curtain applicator 716 and, respectively, toward the drying device, not illustrated.

Figure 9:
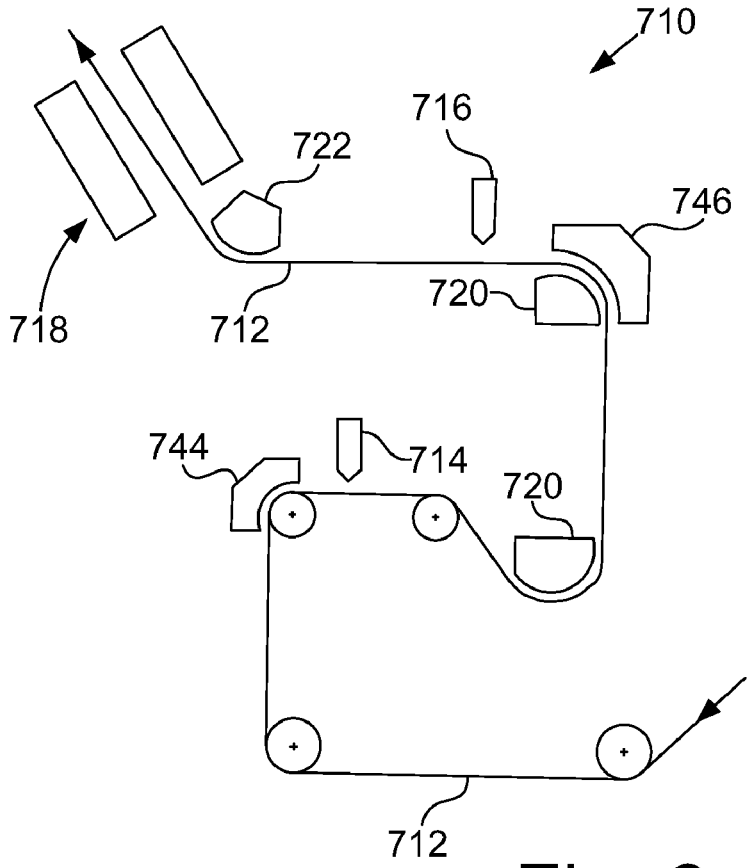

An arrangement very similar to the arrangement of FIG. 6 is shown schematically in FIG. 9. The type and functioning of the components illustrated are given directly by the correspondence of the designations with the designations used in FIG. 6. Air turn 722 deflects material web 712 obliquely upward, not obliquely downward as in FIG. 5.

Figure 10:
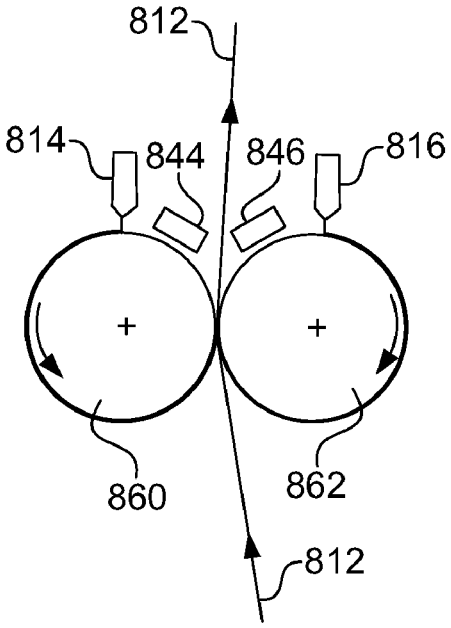
FIGS. 10 and 11 show schematic illustrations of arrangements and web runs in further embodiments of coating/drying devices according to the invention, with a contacting application of the application medium to the moving material web.

An indirect application to both sides of web 812, is accomplished with application rolls 860 and 862, which are, in each case, loaded with a coating film by way of curtain applicators 814 and 816, is shown in FIG. 10. Material web 812 runs through a nip belonging to application rolls 460 and 462. Applicators 814 and 860, on the one hand, and 816 and 862, on the other hand, are accordingly arranged substantially at the same position of material web 812 in the running direction of web 812. The roll surface to be coated by way of curtain applicator heads 814 and 816 is assigned an element 844 and 846 for eliminating, or at least reducing, the air boundary layer, for example what is known as an air cut. Corresponding elements can also be assigned to the sides of material web 812 running into the nip.

Figure 11:
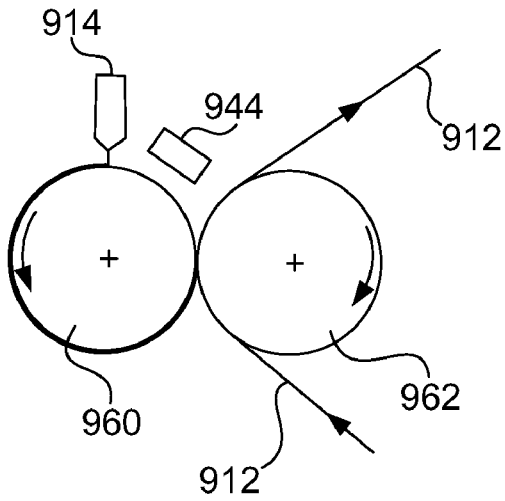

FIG. 11 shows an arrangement very similar to the arrangement of FIG. 10 but in which material web 912 is coated only on one side. Coating roll 960 is therefore assigned only one supporting and guide roll 962, which deflects material web 912 and, together with roll 960, forms a coating nip. Material web 912 runs away from roll 962 and is fed over a non-contact guide arrangement to a further application device, for example a curtain application device, which coats the other side of material web 912.

Referring once more to components or elements 452, 552 and region X and also to elements 444, 446, 544, 546, 644, 646, 744, 746, 844, 846 and 944, it should be pointed out that, for high-value coating results, the avoidance of corrugations and the achievement of a high stability of the web guidance, and also the avoidance, or at least reduction, of the air boundary layers disrupting the application are of great importance in practice. For the purpose of web stabilization and avoiding disruptive corrugations, the coanda effect air nozzle arrangements already mentioned are advantageously suitable which, by way of generating a vacuum, force controlled web guidance and even out any material web corrugations. The application nozzle arrangements have a plurality of nozzles, which are arranged one after another on different web sides in the running direction and which impart to the material web a corrugation in the running direction in a defined manner, which counteracts damaging corrugations in the transverse direction.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A coating/drying device, comprising:

a first curtain application device for applying application medium to a first side of a fiber material web movable in a running direction;

a second curtain application device for applying application medium to a second side of the fiber material web, the second side being opposite the first side, said second curtain application device operating without contacting the fiber material web, said first curtain application device and said second curtain application device being located proximate each other on opposite sides of the fiber material web, the fiber material web running in a substantially vertical direction between said first curtain application device and said second curtain application device as the application medium is applied to said first side of the fiber material web and said second side of said fiber material web; at least one deflection device for deflecting the fiber material web is provided between the first curtain application device and the second curtain application device; the first and the second curtain application devices apply the application medium to the fiber material web at the coating positions, wherein the fiber material web is not in contact with the surface of the at least one deflecting device; and a drying device arranged downstream of said first curtain application device and said second curtain application device in the running direction of the fiber material web wherein no drying device is provided between the position of the first curtain application device and the position of the second curtain application device.

2. The coating/drying device of claim 1, wherein both said first curtain application device and said second curtain application device act without contact with the fiber material web.

3. The coating/drying device of claim 1, said at least one web deflection device assigned to at least one of said curtain application devices, said at least one web deflection device deflecting said application medium curtain coming from said at least one of said curtain application devices from its course under the force of gravity.

4. The coating/drying device of claim 1, wherein said first curtain application device and said second curtain application device are arranged substantially at the same position in the running direction of the fiber material web.

5. The coating/drying device of claim 1, wherein said second curtain application device is arranged downstream of said first curtain application device by a specific distance in the running direction of the fiber material web.

6. The coating/drying device of claim 1, wherein said first curtain application device and said second curtain application device are arranged in a section of a course of the fiber material web that runs substantially horizontally.

7. The coating/drying device of claim 6, the fiber material web between sections that run substantially horizontally is deflected through substantially 180° by way of said at least one web deflection unit.

8. The coating/drying device of claim 7, said at least one web deflection unit being arranged on an uncoated side of the fiber material web.

9. The coating/drying device of claim 1, further comprising a housing, said first curtain application device and said second curtain application device being accommodated in said housing.

10. The coating/drying device of claim 1, wherein the fiber material web has curved sections in the running direction of the fiber material web between said first curtain application device and said drying device, said curved sections having a radius of curvature of at least 300 mm.

11. The coating/drying device of claim 1, further comprising at least one non-contact device for stabilizing the fiber material web as it moves thereby reducing transverse corrugations of the fiber material web.

12. The coating/drying device of claim 11, further comprising at least one coanda effect nozzle arrangement directed toward the fiber material web.

13. The coating/drying device of claim 12, wherein said at least one nozzle arrangement produces at least one of an opposing corrugation and a longitudinal corrugation, thereby counteracting a transverse corrugation.

14. The coating/drying device of claim 1, further comprising at least one apparatus that one of disrupts, eliminates and reduces an air boundary layer dragged along by the fiber material web as it moves in the running direction.

15. A coating/drying device, comprising:

a first application device for applying application medium to a first side of a material web, moving in a running direction;

a second application device for applying application medium to a second side of the fiber material web, said second side being opposite the first side, said first application device and said second application device being arranged substantially at the same position in the running direction of the fiber material web, the running direction being substantially vertical between said first application device and said second application device at least one deflection device for deflecting the fiber material web is provided between the first application device and the second application device; the first and the second application devices apply the application medium to the fiber material web at the coating positions, wherein the fiber material web is not in contact with the surface of the at least one deflecting device; and a drying device arranged downstream of said first application device and said second application device in the running direction of the fiber material web wherein no drying device is provided between the position of the first curtain application device and the position of the second curtain application device.

16. The coating/drying device of claim 15, wherein at least one of said first application device and said second application device is an application device acting without contact.

17. The coating/drying device of claim 16, wherein said application device acting without contact is another application device.

18. The coating/drying device of claim 15, wherein both said first application device and said second application device act without contact with the fiber material web.

19. The coating/drying device of claim 18, wherein at least one of said first application device and said second application device is a curtain application device.

20. The coating/drying device of claim 19, said at least one web deflection device assigned to at least one of said curtain application devices, said at least one web deflection device deflecting said application medium curtain coming from said curtain application device from its course under the force of gravity.

21. The coating/drying device of claim 15, wherein said first application device and said second application device are arranged on a section of the fiber material web running substantially in a vertical direction.

22. The coating/drying device of claim 21, wherein the fiber material web travels from bottom to top proximate said section.

23. The coating/drying device of claim 15, further comprising a housing, said first application device and said second application device being accommodated in said housing.

24. The coating/drying device of claim 15, wherein the fiber material web has curved sections in the running direction of the fiber material web between said first application device and said drying device, said curved sections having a radius of curvature of at least 300 mm.

25. The coating/drying device of claim 15, further comprising at least one non-contact device stabilizing the fiber material web as it moves thereby reducing transverse corrugations of the fiber material web.

26. The coating/drying device of claim 15, further comprising at least one coanda effect nozzle arrangement directed toward the fiber material web.

27. The coating/drying device of claim 26, wherein said at least one nozzle arrangement produces at least one of an opposing corrugation and a longitudinal corrugation, thereby counteracting a transverse corrugation.

28. The coating/drying device of claim 27, further comprising at least one apparatus that one of disrupts, eliminates and reduces an air boundary layer dragged along by the fiber material web as it moves in the running direction.

29. A coating/drying device, comprising:

a first curtain application device for applying application medium to a first side of a fiber material web movable in a running direction;

a second curtain application device for applying application medium to a second side of the fiber material web, the second side being opposite the first side, said second curtain application device operating without contacting the fiber material web, said first curtain application device and said second curtain application device being located directly at the same position on opposite sides of the fiber material web, the fiber material web running in a substantially vertical direction between said first curtain application device and said second curtain application device; at least one deflection device for deflecting the fiber material web is provided between the first curtain application device and the second curtain application device; the first and the second curtain application devices apply the application medium to the fiber material web at the coating positions, wherein the fiber material web is not in contact with the surface of the at least one deflecting device; and a drying device arranged downstream of said first application device and said second application device in the running direction of the fiber material web wherein no drying device is provided between the position of the first curtain application device and the position of the second curtain application device.

* * * * *